United States Patent [19]

Okinaka

[11] Patent Number: 4,903,459

[45] Date of Patent: Feb. 27, 1990

[54] METHOD AND APPARATUS FOR DISCHARGING VACUUM PACKAGED GOODS FROM VACUUM PACKAGING APPARATUS

[75] Inventor: Keizo Okinaka, Mihara, Japan

[73] Assignee: Furukawa Mfg. Co., Ltd., Tokyo, Japan

[21] Appl. No.: 276,710

[22] Filed: Nov. 28, 1988

[30] Foreign Application Priority Data

May 29, 1986 [JP] Japan ..... 61-125009

[51] Int. Cl.[4] ..... B65B 31/02; B65B 7/06; B65B 51/10; B65B 57/10

[52] U.S. Cl. ..... 53/434; 53/77; 53/373; 53/479; 53/512

[58] Field of Search ..... 53/77, 373, 434, 479, 53/481, 507, 512

[56] References Cited

U.S. PATENT DOCUMENTS

| | | | |
|---|---|---|---|
| 2,740,243 | 4/1956 | Mahaffy | 53/95 |
| 2,966,019 | 12/1960 | Gragingholt | 53/512 X |
| 4,176,506 | 12/1979 | Landolt | 53/512 X |
| 4,538,399 | 9/1985 | Müller | 53/95 X |
| 4,578,928 | 4/1986 | Andre et al. | 53/512 |
| 4,586,320 | 5/1986 | Takai et al. | 53/512 |
| 4,640,081 | 2/1987 | Kawaguchi et al. | 53/512 X |
| 4,754,596 | 7/1988 | Yasumune et al. | 53/479 X |

*Primary Examiner*—John Sipos
*Assistant Examiner*—Beth Bianca
*Attorney, Agent, or Firm*—Barnes, Kisselle, Raisch Choate, Whittemore & Hulbert

[57] ABSTRACT

A method and apparatus for discharging vacuum packaged goods from a vacuum packaging apparatus. While a chamber held in contact with the upper surface of a table and defining an airtight space therein is in movement integrally with the table for one round of travel along an endless track, the chamber is lifted from the table for a given period of time for supply into the chamber of goods to be packaged as contained in a bag. When the chamber is again brought in contact with the table, a vacuum atmosphere is created in the chamber so that the mouth of the bag is sealed, vacuum packaged goods being thus obtained. A table portion within the chamber is formed with an open/close type drop opening which is sealed by a cover plate. The to-be-packaged goods contained in a bag, as well as vacuum packaged goods which are sealed at the mouth of the bag, are loaded on the cover plate. When air is introduced into the chamber in which a vacuum atmosphere is present, for discharge of the vacuum packaged goods, the cover plate is opened downwardly so that the vacuum packaged goods are discharged through the drop opening before the chamber leaves the table.

7 Claims, 4 Drawing Sheets

METHOD AND APPARATUS FOR DISCHARGING VACUUM PACKAGED GOODS FROM VACUUM PACKAGING APPARATUS

FIELD OF THE INVENTION

This invention relates to a method and apparatus for discharging vacuum packaged goods from a vacuum packaging apparatus of the type in which a table and a multiplicity of chambers held in contact therewith are movable integrally along a circular or ellipsoidal endless track so that vacuum is applied to foodstuff filled in a bag within each of the chambers before the table and the chambers travel around the endless track for return to their original position.

BACKGROUND OF THE INVENTION

In U.S. Pat. No. 2,740,243, there is disclosed a vacuum packaging apparatus of such arrangement that a multiplicity of chambers are movable integrally with a large circular table which is rotatable on its center portion as a rotation axis, each of the chambers being adapted to be separated from the table at a predetermined position, whereby if a foodstuff loaded bag is supplied to the underside of the chamber at the position at which the chamber is off the table, the foodstuff in the bag is caused to move integrally with the table and a vacuum atmosphere is created around the foodstuff before the foodstuff returns to its original position, the mouth of the bag being heat-sealed sealed in the vacuum atmosphere.

Another arrangement is disclosed in U.S. Pat. No. 2,958,391 such that a multiplicity of square tables are moved along an ellipsoidal track having a circular track portion at one side and chambers are sequentially placed on individual tables at the circular track portion so that foodstuffs are vacuum packaged within individual hermetic spaces defined between the table and the chambers.

Another vacuum packaging apparatus is disclosed in U.S. Pat. No. 4,538,399 wherein four tables and four chambers are rotated along a circular track so that foodstuff is vacuum packaged in each of the individual chambers while the tables and the chambers are in their rotational movement along the circular track.

In all these vacuum packaging apparatuses, the upper surface of the table is flatly configured to facilitate sliding of goods thereon so that foodstuff can be easily set in position under each chamber even when the table is in continuous rotation, while on the other hand vacuum packaged goods can be removed from the table comparatively easily. Therefore, the apparatuses are well suited for the purpose of high efficiency vacuum packaging of, for example, comparatively heavy cut pieces of meat.

In operation of such vacuum packaging apparatus, as the chambers are lifted and separated from the table, vacuum packaged goods on the table are removed therefrom and then a fresh supply of cut pieces of meat contained in bags is delivered to the table. Thereupon, the chambers are lowered onto the table for contact therewith; and a vacuum atmosphere is gradually created around the cut pieces of meat, the mouth of each bag being then heat sealed. The heat sealed mouth of each bag is allowed to become solidified by natural drying or forced drying and then air is introduced into the chambers for separation thereof from the table. This series of operation is repeated for each turn of the table around the endless track. The speed of rotation of the table and chambers is set to the maximum permissible limit so that the series of operation is carried out efficiently and without loss of time in the course of one turn of the table.

However, a close examination of the foregoing series of operation reveals that the operation of discharging vacuum packaged goods from the table after air is introduced into the chambers, with time allowed for the chambers, which are rather heavy, being lifted and separated from the table, leaves some room for improvement from the standpoint of operation efficiency. When introduction of air into each chamber begins, the atmosphere acting on the chamber operates to urge the chamber against the table; therefore, if there is any slight pressure difference between the interior of the chamber and its exterior, the chamber cannot be separated from the table, and only when the pressure difference is completely gone, the chamber can be removed from the table. Further, the chamber, if it is heavy, cannot be rapidly separated from the table, and as such, relatively long time is required after introduction of air into the chamber begins and until vacuum packaged goods on the table are removed from the table.

SUMMARY OF THE INVENTION

In view of aforesaid problem, it is primary object of the invention to provide a method and apparatus for discharging vacuum packaged goods from a vacuum packaging apparatus wherein individual chambers are open downward so that vacuum packaged goods are discharged downward through the opening by best utilizing the downwardly acting gravitational forces, whereby improved packaging efficiency can be obtained.

In order to accomplish this object, the method for discharging vacuum packaged goods from a vacuum packaging apparatus of present invention comprises:

causing a table having drop openings sealed by a cover plate, and chambers held in contact with the upper surface of the table at positions corresponding to the individual drop openings and each defining an airtight space in its interior, to move integrally together along an endless track, separating each of the chambers from the table for a given period of time within a specified range of rotation angles of the table and the chambers in the course of their making one turn along the endless track, to supply goods to be packaged as contained in a bag onto the corresponding cover plate, bringing the chamber again into contact with the table to cover the table with the chamber at a portion surrounding the bag supplied, and then sealing the mouth of the bag by creating a vacuum atmosphere in the internal space of the chamber, and introducing air into the chamber for discharging vacuum packaged goods as produced by sealing the mouth of the bag under the vacuum atmosphere, and simultaneously uncovering the drop opening by opening the cover plate downward, thereby discharging downward the vacuum packaged goods resting on the cover plate through the drop opening before the chamber is completely separated upward from the table.

The apparatus for discharging vacuum packaged goods from a vacuum packaging apparatus in accordance with the present invention comprises:

a table movable along an endless track, chambers adapted to be brought into contact with the upper surface of the table to define an airtight space therein and movable integrally with the table along the endless track, a drop opening formed in the plane of the table at the underside of each of the chambers, a cover plate capable of airtightly sealing said drop opening at the underside of the table and movable downward to uncover the drop opening, means for urging said cover plate upward in the course of movement of the table for sealing the drop opening, means for lifting each of said chambers to separate it from the table for a given period of time within a specified range of rotation angles of the table and the chambers in the course of their making one turn along the endless track, to supply goods to be packaged as contained in a bag onto the corresponding cover plate, means for creating a vacuum atmosphere in the internal space of the chamber when the chamber as supplied with the bag is again brought in contact with the table to thereby enclose the bag, means for sealing the mouth of said bag in the chamber under the vacuum atmosphere, and means for allowing said cover plate to move downward when air is introduced into the chamber after the mouth of the bag is sealed and when the chamber is to be separated from the table, whereby the vacuum packaged goods resting on the cover plate are discharged downward from the table before the chamber is completely separated from the table.

The drop opening formed in the table is airtightly covered with the cover plate from below, and therefore when goods to be packaged as contained in a bag are supplied into each chamber, the goods to be packaged are mounted on the cover plate so that the goods are transported integrally with the table and, after they are allowed to stand in an vacuum atmosphere in the chamber, the mouth of the bag is sealed, the goods being thus vacuum packaged. Thereafter, at a position through which air is introduced into the chamber in order to separate the chamber from the table, the cover plate, under the own weight of both the cover plate and the vacuum packaged goods, is constantly acted upon by a biasing force that urges the cover plate away from the table; and therefore the cover plate is allowed to open downward when there is a little pressure difference between the interior and the exterior of the chamber, the vacuum packaged goods being thus discharged under their own weight. In this case, a combination of the weight of the cover plate and the weight of the vacuum packaged goods acts on the cover plate, so that when the combined weight of the cover plate and the vacuum packaged goods is slightly greater than a pressure difference that urges the cover plate against the underside of the table, the cover plate is automatically opened downward. Thus, the vacuum packaged goods are discharged before the chamber is lifted from the table. Moreover, a large amount of air is allowed to flow into the chamber immediately upon the cover plate being released, and therefore the timing for lifting the chamber from the table can be prompted. Thus, it is possible to increase the velocity of rotation of the table and the chambers and to achieve further improvement in packaging efficiency.

PREFERRED EMBODIMENTS

Figure 1:
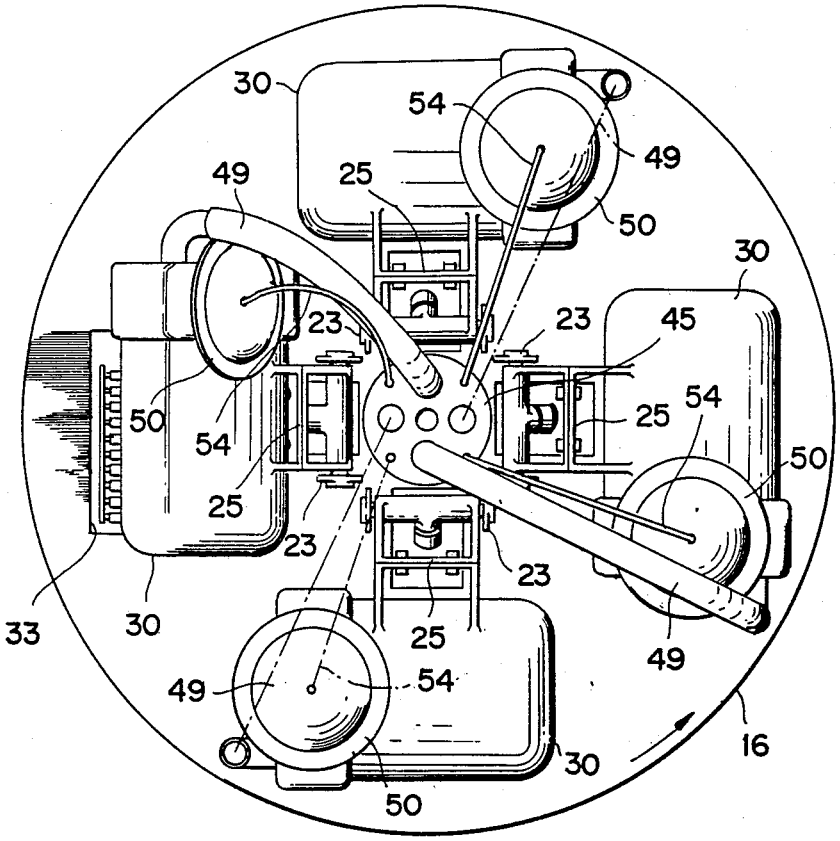
FIG. 1 is a plan view showing one embodiment of the apparatus for discharging vacuum packaged goods from a vacuum packaging apparatus in accordance with the invention.

One preferred embodiment of the present invention will now be described with reference to FIGS. 1 through 6. A vacuum pipe 13 is mounted in a position which vertically extends through a machine frame 10 and further through a column 12 fixed on the frame 10 by means of bolts and nuts 11. A gear 15 is mounted on the top of the column 12 through a thrust bearing 14, and a large circular table 16 is fixed in position on the top of the gear 15 through a plurality of screws 17. A motor 18 installed in the machine frame 10 and a reduction gear 19 disposed on the frame 10 are interconnected through a belt 20; and a pinion 21 mounted on an output shaft of the reduction gear 19 is in engagement with the gear 15. Accordingly, the driving power from the motor 18 is transmitted to the gear 15 via the belt 20, the reduction gear 19, and the pinion 21 to thereby rotate the table 16 continuously.

Four L-shaped levers 25 are radially disposed on the table 16 by being individually supported in four bearings 23, 23, 23, 23 fixed on the upper surface of the table 16 and through pins 24, the levers 25 being rotatable about the corresponding pins 24. A cylindrical tire 26 is rotatably mounted to the lower end of each of the levers 25, which tire 26 is held in contact with the outer periphery of a circular guide 28 mounted on the machine frame 10 through a frame 27. Chambers 30 are individually fixed to the upper ends of the levers 25 and the tires 26 are pressed against the outer periphery of the guide 28 under the weight of the chambers 30. A portion of the circular guide 28 projects outward so that when each chamber 30 which is in rotation integrally with the table 16 reaches the projecting portion of the guide 28, the chamber 30 is lifted by said projecting portion while being pivotally supported on the corresponding pin 24, whereby the chamber 30 is separated from the table 16.

Figure 2:
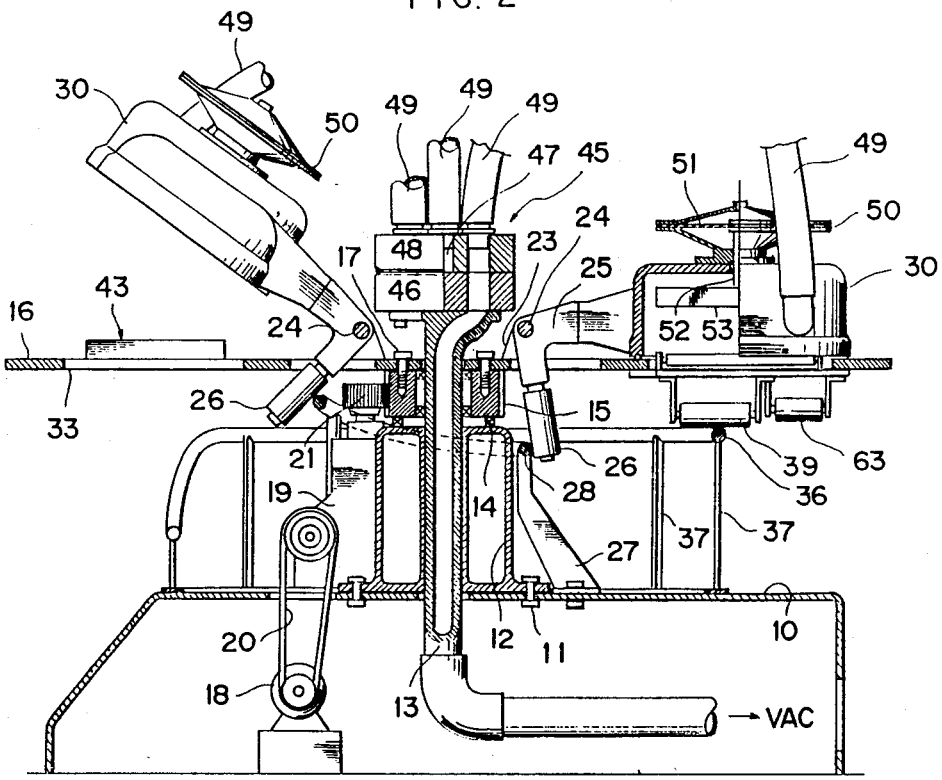
FIG. 2 is a longitudinal sectional view of the apparatus shown in FIG. 1.
Figure 4:
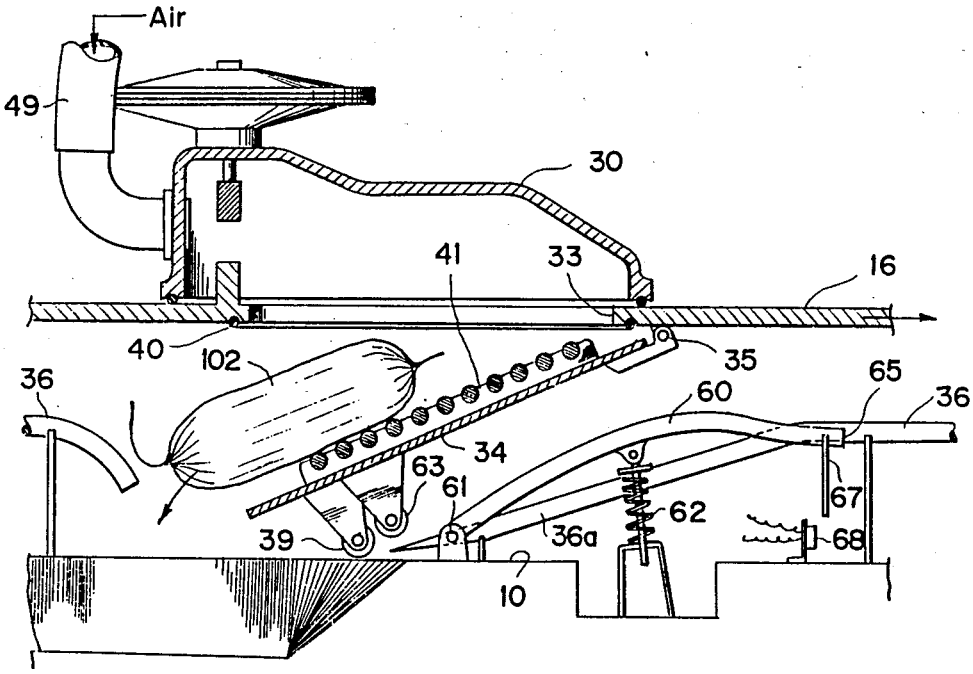
FIG. 4 is a sectional view illustrating the chamber shown in FIG. 3 as it appears when in a cover plate opening position.
Figure 5:
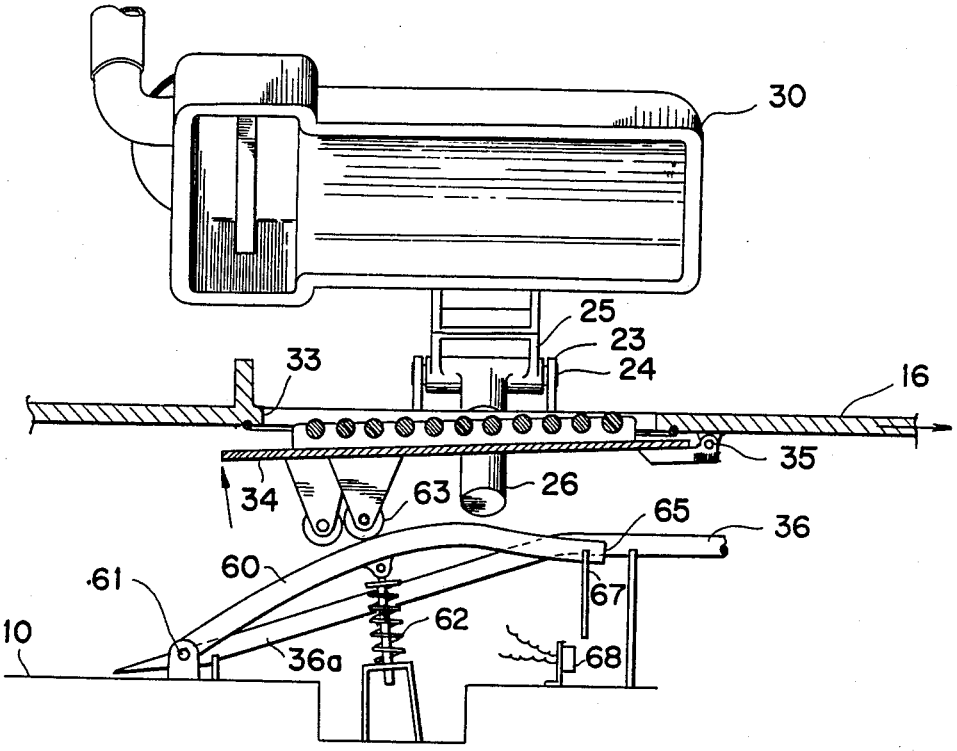
FIG. 5 is a sectional view illustrating the chamber shown in FIG. 4 as it appears when the cover plate is being closed.
Figure 6:
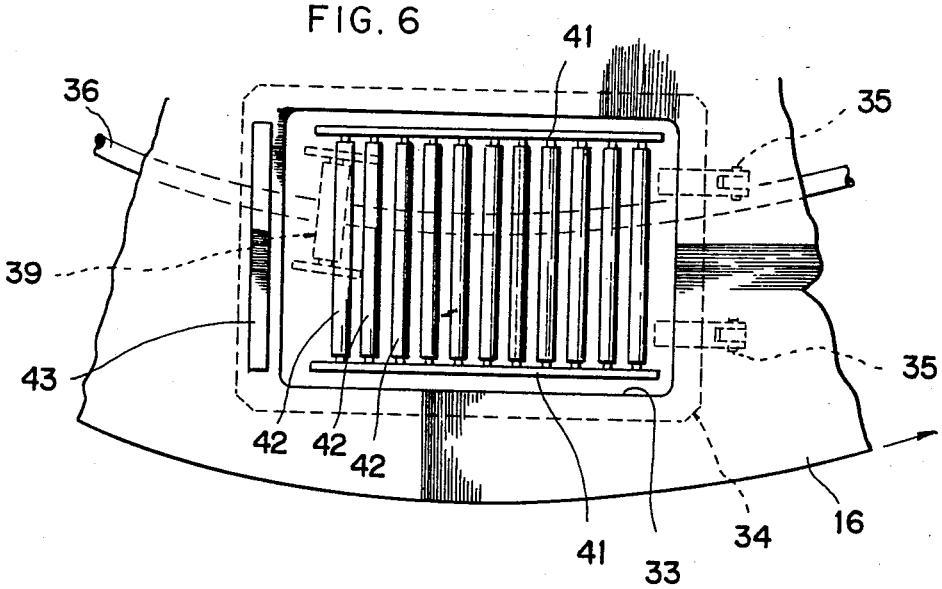
FIG. 6 is a plan view showing a portion of the table in position of FIG. 3.

As can be seen from FIGS. 3 to 6, a drop opening 33 is formed in the table 16 at the underside of each chamber 30 and a cover plate 34 having an area sufficient to cover the drop opening 33 is provided under the drop opening, the cover plate 34 being pivotally supported at one end on the underside of the table 16 through hinges 35. As FIG. 2 shows, a circular rail 36 is supported on the machine frame 10 by a plurality of legs 37, 37 . . . , while wheels 39 are mounted to the underside of the cover plates 34 by trough brackets 38 so that they are in roll engagement with the rail 36. Through this rail 36 the cover plate 34 is pressed for hermetic contact with packing 40 provided along the edge of the drop opening 33. As FIG. 6 illustrates, a multiplicity of rod-shaped rollers 42, 42 . . . are rotatably supported between a pair of side plates 41, 41 fixed on the upper surface of the cover plate 34 at both sides thereof. Immediately upon placement on each roller 42 of a bag 101 in which a foodstuff 100 is contained, the mouth edge of the bag 101 can be brought in alignment with a sleeper 43 disposed along the edge of the drop opening.

As FIG. 2 shows, the vacuum pipe 13 concurrently serves as a rotation shaft for the table 16, and on the top end of the vacuum pipe 13 there is provided a rotary valve 45. The rotary valve 45 comprises a stationary platen 46 fixed to the vacuum pipe 13 and a movable platen 48 which is rotatable about a shaft 47 provided centrally on the fixed platen 46. Four flexible tubes 49, 49, 49, 49 are connected at one end to the top of the movable platen 48 and at the other end to the individual chambers 30 . . . so that the vacuum pipe 13 is in communication with the respective interiors of the chambers 30 . . . . On the upper surface of each chamber 30 there is provided an actuator 50 having a diaphragm 51 therein, to which diaphragm 51 a rod 52 is fixed at its upper end, the lower end of said rod 52 projecting into the chamber 30. The lower end of the rod 52 is provided with a seal bar 53 in the chamber 30. An upper compartment located above the diaphragm 51 in each actuator 50 is connected with the rotary valve through a narrow tube 54.

Figure 3:
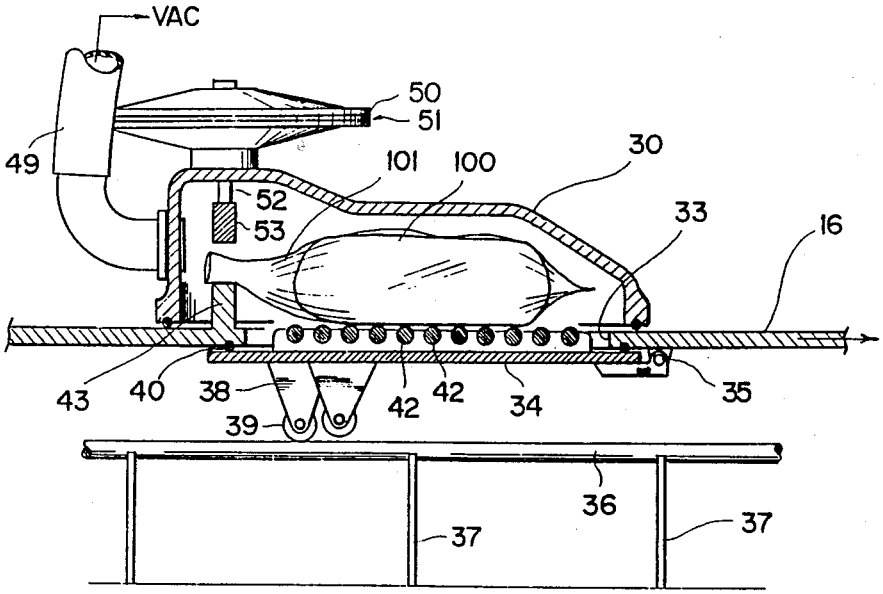
FIG. 3 is a sectional view showing a chamber and a portion of a table as seen in FIGS. 1 and 2.

By the individual chambers 30 . . . being brought in rotation integrally with the table 16, the movable platen 48 which is connected to the chambers 30 . . . through tubes 49 . . . is pulled by the individual chambers 30 . . . so that it is allowed to rotate on the top surface of the stationary platen 46 at same cycle with the table 16, whereby the suction force of a vacuum pump connected to the vacuum pipe 13 is sequentially acted on the interiors of the individual chambers 30 for a given period of time. Thus, as FIG. 3 shows, vacuum is applied to the interior of the bag 101 covering the foodstuff 100 in each chamber 30. When sufficient vacuum is applied to the interior of the bag 101, air is allowed to flow into a space above the diaphragm 50 in the actuator 50 through the rotary valve 45. By this inflow of air there occurs a pressure difference between the upper and lower portions defined by the diaphragm 51, whereupon the seal bar 53 is lowered to press the mouth of the bag against the sleeper 43 and simultaneously the mouth of the bag is heat sealed by an impulse current.

Immediately after the mouth of the bag is heat sealed in this way, as FIG. 4 shows, air is introduced from the rotary valve 45 into the chamber 30 through tube 49. The endless form rail 36 is cut away, as shown in FIG. 4, over an area through which air is introduced into the chamber 30; by this cut-away of the rail 36 the combined weight of the vacuum packaged goods 102 and the cover plate 34 serves as a biasing force for urging the cover plate 34 to be opened downward. Therefore, as the difference in pressure between the interior and the exterior of the chamber 30 is reduced, the cover plate 35 is pivoted at the hinges 35 to open itself, thereby discharging the vacuum packaged goods 102 downward.

As can be seen in FIGS. 4 and 5, there is provided a separate rail 60 extending in the direction of movement of the table 16 and in parallel relation with one end 36a of the cutaway rail 36. This rail 60, which functions as a safety rail, is of such construction that the rail 60 is pivotally supported at one end on the machine frame 10 through a pin 61 and upwardly biased at a median portion thereof by a coil spring 62 disposed below the rail, whereby the safety rail 60 is configured to be of an inclined pattern. An auxiliary wheel 63 mounted on the underside of the cover plate 34 is in engagement with the safety rail 60, and thus the cover plate 34 can be lifted by the coil spring 62, there being no possibility of the coil spring 62 being substantially compressed by the weight of the cover plate 34 alone. However, if vacuum packaged goods 102 remain undischarged from the cover plate 34, the goods 102 are naturally caught between the edge of the drop opening 33 and the cover plate 34; therefore, the cover plate 34 cannot smoothly be lifted, in which case the coil spring 62 is compressed so that free end 65 of the safety rail 60 is moved downward. Thereupon, a detecting plate 67 moves toward a proximity switch 68 and power supply for the motor 18 in FIG. 1 is cut by the proximity switch 68. Normally, however, by virtue of the safety rail 60, the cover plate 34 moves upward to seal the drop opening 33 before the chamber 30 is completely lifted, and accordingly a new bag in which foodstuff is contained is supplied onto the cover plate 34, preparation being thus made for a next cycle of vacuum packaging.

What is claimed is:

1. A method for discharging vacuum packaged goods from a vacuum packaging apparatus which comprises:

causing a table having drop openings sealed by cover plates pivotally supported at one end on the underside of the table, and chambers held in contact with the upper surface of the table at positions corresponding to the individual drop openings and each defining an airtight space in its interior, to move integrally together along an endless track, separating each of the chambers from the table for a given period of time within a specified range of rotation angles of the table and the chambers in the course of their making one turn along the endless track, to supply goods to be packaged as contained in a bag onto the corresponding cover plate, bringing the chamber again into contact with the table to cover the table with the chamber at a portion surrounding the bag supplied, and then sealing the mouth of the bag by creating a vacuum atmosphere in the internal space of the chamber, and introducing air into the chamber for discharging vacuum packaged goods as provided by sealing the mouth of the bag under the vacuum atmosphere, and simultaneously uncovering the drop opening by opening the cover plate such that the cover plate is inclined downwardly from said one end toward the other end thereby discharging downward the vacuum packaged goods resting on the cover plate through the drop opening before the chamber is completely separated upward from the table.

2. An apparatus for discharging vacuum packaged goods from a vacuum packaging apparatus comprising:

a table movable along an endless track, chambers adapted to be brought into contact with the upper surface of the table to define an airtight space therein and movable integrally with the table along the endless track, a drop opening formed in the plane of the table at the underside of each of the chambers, a cover plate capable of airtightly sealing said drop opening at the underside of the table and movable downward to uncover the drop opening, means for urging said cover plate upward in the course of movement of the table for sealing the drop opening, means for lifting each of said chambers to separate it from the table for a given period of time within a specified range of rotation angles of the table and the chambers in the course of their making one turn along the endless track, to supply goods to be packaged as contained in a bag onto the corresponding cover plate, means for creating a vacuum atmosphere in the internal space of the chamber when the chamber as supplied with the bag is again brought in contact with the table to thereby enclose the bag, means for sealing the mouth of said bag in the chamber under the vacuum atmosphere, and means for allowing said cover plate to move downward when air is introduced into the chamber after the mouth of the bag is sealed and when the chamber is to be separated from the table, whereby the vacuum packaged goods resting on the cover plate are discharged downward from the table before the chamber is completely separated from the table, the cover plate being pivotally supported at one end on the underside of the table and pivotally movable at the other end toward and away from the underside of the table, said cover plate being inclined downwardly from said one end toward said other end when said other end is moved away from the underside of the table.

3. An apparatus as set forth in claim 2, wherein:

the cover plate has rollers, said rollers being able to support thereon goods to be packaged as contained in a bag and vacuum packaged goods the mouth of whose bag has been sealed under a vacuum atmosphere, said rollers being adapted to guide the vacuum packaged goods for movement in the direction of tilt of the cover plate when tilted.

4. An apparatus as set forth in claim 2, wherein:

the discharge means include a roller mounted on the underside of the cover plate and a rail for guiding the roller, said rail being so disposed as to enable the cover plate to be urged upward by said roller when goods to be packaged are supplied onto the table at each chamber position and also when a vacuum atmosphere is created in the chamber, and as to be able to guide said roller for downward movement of the cover plate when air is introduced into the chamber after the mouth of the bag being sealed.

5. An apparatus as set forth in claim 4, wherein:

the rail is partially cut away at a position to allow downward movement of the cover plate.

6. An apparatus for discharging vacuum packaged goods from a vacuum packaging apparatus comprising:

a table movable along an endless track, chambers adapted to be brought into contact with the upper surface of the table to define an airtight space therein and movable integrally with the table along the endless track, a drop opening formed in the plane of the table at the underside of each of the chambers, a cover plate capable of airtightly sealing said drop opening at the underside of the table and movable downward to uncover the drop opening, means for urging said cover plate upward in the course of movement of the table for sealing the drop opening, means for lifting each of said chambers to separate it from the table for a given period of time within a specified range of rotation angles of the table and the chambers in the course of their making one turn along the endless track, to supply goods to be packaged as contained in a bag onto the corresponding cover plate, means for creating a vacuum atmosphere in the internal space of the chamber when the chamber as supplied with the bag is again brought in contact with the table to thereby enclose the bag, means for sealing the mouth of said bag in the chamber under the vacuum atmosphere, and means for allowing said cover plate to move downward when air is introduced into the chamber after the mouth of the bag is sealed and when the chamber is to be separated from the table, whereby the vacuum packaged goods resting on the cover plate are discharged downward from the table before the chamber is completely separated from the table, means for detecting defective discharge of vacuum packaged goods such that the goods are caught between the edge of the drop opening and the cover plate when the cover plate opened for discharge of the goods is going to move upward for return to its original position.

7. An apparatus as set forth in claim 6, comprising: a guide roller mounted to the underside of the cover plate, a safety rail disposed in an upwardly slanted pattern and adapted to guide said guide roller gradually upwardly, said rail being pivotally supported at its lower end for upward and downward pivotal movement, means for urging said safety rail upward so as to cause it to guide the guide roller gradually upwardly to close the cover plate after vacuum packaged goods are satisfactorily discharged during an opening operation of the cover plate, said means being adapted to allow the safety rail to be displaced downwardly as the rail is urged downward by the guide rollers under a reaction force from the cover plate when the vacuum packaged goods are caught between the edge of the drop opening and the cover plate, and means for detecting said downward displacement of said safety rail.

* * * * *